US010088217B2

(12) United States Patent
Baeuerle et al.

(10) Patent No.: US 10,088,217 B2
(45) Date of Patent: Oct. 2, 2018

(54) REFRIGERATION DEVICE COMPRISING A WATER TANK

(71) Applicant: BSH HAUSGERAETE GMBH, Munich (DE)

(72) Inventors: Alexander Baeuerle, Munich (DE); Eugen Gaplikow, Guenzburg (DE); Andreas Lindel, Heidenheim (DE); Ulrich Schlander, Nersingen (DE)

(73) Assignee: BSH Hausgeraete GmbH, Munich (DE)

( * ) Notice: Subject to any disclaimer, the term of this patent is extended or adjusted under 35 U.S.C. 154(b) by 341 days.

(21) Appl. No.: 14/651,780

(22) PCT Filed: Dec. 9, 2013

(86) PCT No.: PCT/EP2013/075905
§ 371 (c)(1),
(2) Date: Jun. 12, 2015

(87) PCT Pub. No.: WO2014/090719
PCT Pub. Date: Jun. 19, 2014

(65) Prior Publication Data

US 2015/0308729 A1 Oct. 29, 2015

(30) Foreign Application Priority Data

Dec. 12, 2012 (DE) ..... 10 2012 222 852

(51) Int. Cl.

| | |
|---|---|
| ***F25D 3/00*** | (2006.01) |
| ***F25D 17/02*** | (2006.01) |
| ***F25D 23/12*** | (2006.01) |
| ***B65D 47/32*** | (2006.01) |

(52) U.S. Cl.
CPC ..... *F25D 17/02* (2013.01); *B65D 47/32* (2013.01); *F25D 23/126* (2013.01); *F25D 2323/122* (2013.01)

(58) Field of Classification Search
CPC ..... F25D 23/126; F25D 31/002; F25C 5/005
USPC ..... 62/338, 389, 393
See application file for complete search history.

(56) References Cited

U.S. PATENT DOCUMENTS

| | | | | |
|---|---|---|---|---|
| 3,511,415 | A | 5/1970 | Crowe | |
| 3,834,178 | A * | 9/1974 | Pink | F25D 23/126 62/338 |
| 4,739,629 | A * | 4/1988 | True | F25D 23/126 165/81 |
| 5,315,845 | A | 5/1994 | Lee | |
| 7,194,872 | B2 | 3/2007 | Kim et al. | |
| 8,057,665 | B2 | 11/2011 | Kim et al. | |
| 8,980,161 | B2 * | 3/2015 | Rowley | B29C 49/04 264/453 |
| 2007/0074529 | A1 | 4/2007 | Lim | |

FOREIGN PATENT DOCUMENTS

| | | |
|---|---|---|
| EP | 2204506 A2 | 7/2010 |
| WO | 03033976 A1 | 4/2003 |

* cited by examiner

*Primary Examiner* — Melvin Jones
(74) *Attorney, Agent, or Firm* — Laurence A. Greenberg; Werner H. Stemer; Ralph E. Locher

(57) ABSTRACT

A refrigeration device contains a water tank for drinking water. The water tank has a water channel for storing the drinking water, a vent channel for venting the water channel, and a constriction being formed in the venting channel for stemming the flow of the drinking water through the venting channel.

14 Claims, 8 Drawing Sheets

REFRIGERATION DEVICE COMPRISING A WATER TANK

BACKGROUND OF THE INVENTION

Field of the Invention

The present invention relates to a refrigeration appliance with a water tank for drinking water.

Additional water tanks can be incorporated in refrigeration appliances for the dispensing of chilled drinking water for human consumption. To prevent subsequently added, unchilled drinking water mixing with chilled drinking water, such water tanks have for example an extended, serpentine water channel, into which the drinking water is introduced for storage therein. However air can collect in said water channel, having an adverse effect on the function of the water tank. If a venting channel is connected to the water channel, drinking water can pass through the venting channel. This can also have an adverse effect on the function of the water tank, for example if warm drinking water passes through the venting channel and mixes with the chilled drinking water.

The publication WO 03/033976 A1 describes a refrigeration appliance with a door, in which a water tank is integrated.

BRIEF SUMMARY OF THE INVENTION

The object underlying the invention is to specify a refrigeration appliance with an improved water tank.

This object is achieved by subject matter with the features claimed in the independent claim. Advantageous embodiments of the invention are the subject matter of the figures, the description and the dependent claims.

According to one aspect of the invention the object is achieved by a refrigeration appliance with a water tank for drinking water, which comprises a water channel for storing the drinking water with a venting channel for venting the water channel, in which a constriction is formed to stem the passage of drinking water through the venting channel. The constrictions are formed in such a manner that an air flow can pass through them, while a significant flow resistance is formed for a water flow. This has the technical advantage for example that there is no adverse effect on the function of the water tank. It is also possible to stem or prevent the formation of a hydrodynamic short circuit or bypass by water passing through the venting channel within the water tank.

A refrigeration appliance refers in particular to a domestic refrigeration appliance, in other words a refrigeration appliance used for domestic management in a domestic situation or in the catering sector, which serves in particular to store food and/or beverages at defined temperatures, for example a refrigerator, a freezer cabinet, a fridge/freezer combination appliance, a chest freezer or a wine chiller cabinet.

In one advantageous embodiment of the refrigeration appliance the water channel runs in a serpentine manner within the water tank. The serpentine course is produced for example by a sequence of s-shaped loops which bring about a change in the direction of the flow. This has the technical advantage for example that the water tank can be produced in a flat manner and warm water can be added subsequently at an inlet while cold drinking water is dispensed at the outlet.

In a further advantageous embodiment of the refrigeration appliance the venting channel connects two upper bends of the serpentine course. This has the technical advantage for example of allowing the dissipation of air that has collected in the bends of the water channel.

In a further advantageous embodiment of the refrigeration appliance the venting channel connects all the upper bends of the serpentine course. This has the technical advantage for example of allowing complete venting of the water channel to be achieved.

In a further advantageous embodiment of the refrigeration appliance the constriction in the venting channel is formed between two upper bends of the serpentine course. This has the technical advantage for example of preventing the passage of water between the two bends.

In a further advantageous embodiment of the refrigeration appliance the venting channel is connected to an outlet region of the water channel. This has the technical advantage for example that the air is guided out from the water tank with a water flow.

In a further advantageous embodiment of the refrigeration appliance the constriction of the venting channel is arranged in the outlet region of the water channel. This has the technical advantage for example of preventing the passage of warm drinking water into a dispensing region.

In a further advantageous embodiment of the refrigeration appliance the venting channel runs in a straight line. This has the technical advantage for example of allowing air to be dissipated out of the tank with a small flow resistance.

In a further advantageous embodiment of the refrigeration appliance the constriction is formed in the manner of a slit. This has the technical advantage for example of allowing the constriction to be formed in a simple manner by squashing the sides of the venting channel together.

In a further advantageous embodiment of the refrigeration appliance the constriction is formed in the region of an upper wall of the venting channel. This has the technical advantage for example of improving the dissipation of air bubbles within the venting channel further.

In a further advantageous embodiment of the refrigeration appliance an inlet of the water channel is formed adjacent to an outlet of the water channel. This has the technical advantage for example of allowing the connectors of the water tank to be connected to adjacently arranged water lines.

In a further advantageous embodiment of the refrigeration appliance the inlet of the water channel is connected to the outlet of the water channel by an inlet venting channel for venting the inlet. This has the technical advantage for example of allowing air in the inlet region of the water channel to be dissipated in a simple manner.

In a further advantageous embodiment of the refrigeration appliance the inlet comprises a hose segment in the interior of the water channel for conducting the drinking water past the inlet venting channel. This has the technical advantage for example of preventing the passage of newly introduced drinking water into the outlet region.

In a further advantageous embodiment of the refrigeration appliance a constriction for stemming or preventing the passage of drinking water through the inlet venting channel is formed in the inlet venting channel. This also has the technical advantage for example of preventing the passage of newly introduced drinking water into the outlet region.

In a further advantageous embodiment of the refrigeration appliance the water tank is a blow-molded tank. This has the technical advantage for example of allowing the tank to be produced in a simple manner with the constriction.

BRIEF DESCRIPTION OF THE SEVERAL VIEWS OF THE DRAWING

Exemplary embodiments of the invention are described in more detail below and illustrated in the drawings, in which.

DESCRIPTION OF THE INVENTION

Figure 1:
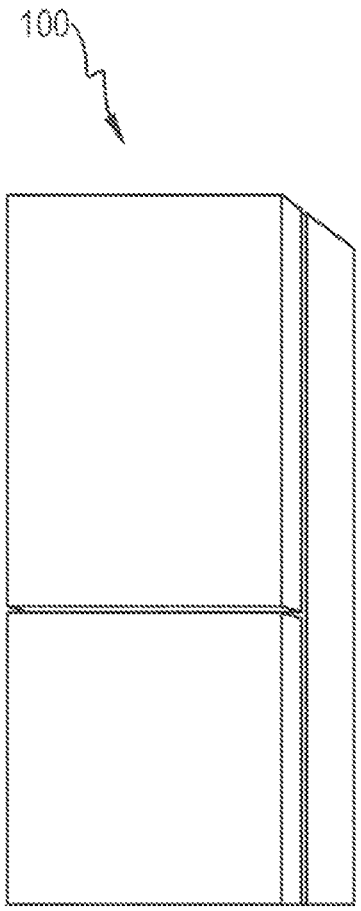
FIG. 1 shows a schematic view of a refrigeration appliance.

FIG. 1 shows a refrigeration appliance 100 in the form of a refrigerator with an upper refrigerator door and a lower refrigerator door. The refrigerator serves for example to chill food and comprises a refrigerant circuit with an evaporator, a compressor, a condenser and a throttle device. The evaporator is a heat exchanger, in which after expansion the liquid refrigerant is evaporated by the absorption of heat from the medium to be cooled, in other words the air in the interior of the refrigerator.

The compressor is a mechanically operated component, which takes in refrigerant vapor from the evaporator and expels it to the condenser at a higher pressure. The condenser is a heat exchanger, in which after compression the evaporated refrigerant is condensed by the emission of heat to an external cooling medium, in other words the ambient air. The throttle device is an apparatus for continuously reducing pressure by cross-sectional narrowing.

The refrigerant is a fluid used to transmit heat in the cold-generating system, absorbing heat when the fluid is at low temperatures and low pressure and emitting heat when the fluid is at higher temperature and higher pressure, with state changes of the fluid generally also being taken into account.

A water tank for dispensing chilled drinking water can be arranged in the interior of the refrigeration appliance 100.

Figure 2:
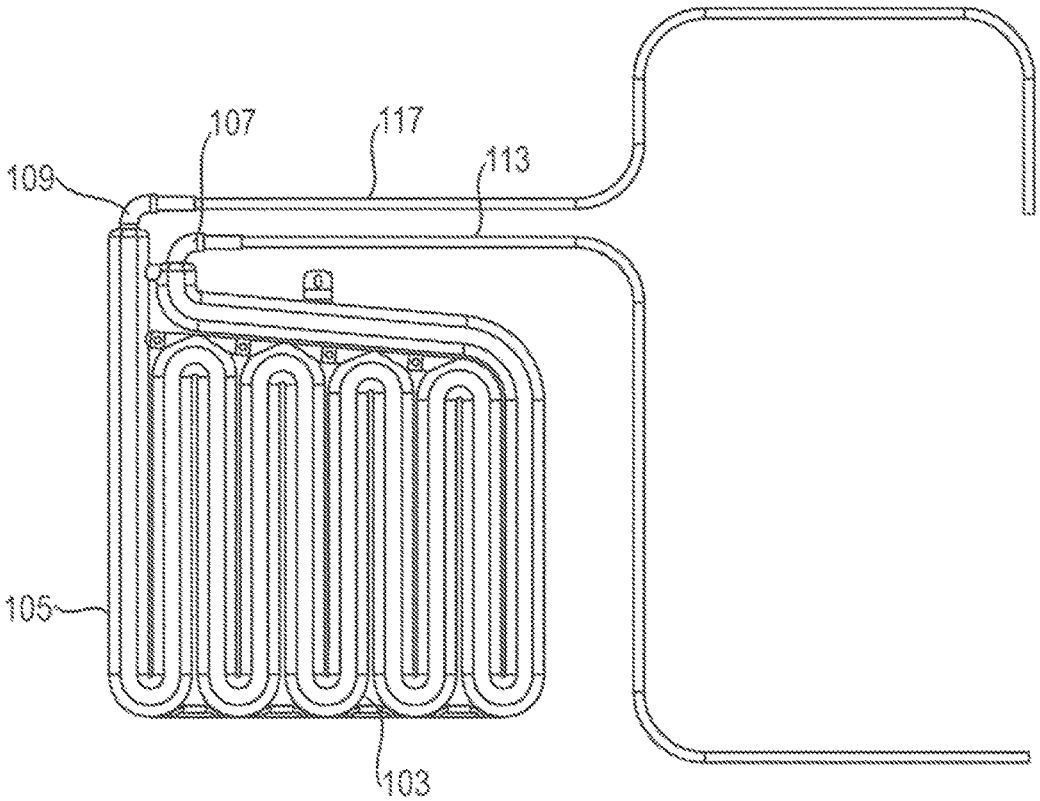
FIG. 2 shows a view of a water tank.

FIG. 2 shows a view of the water tank 103 as a water container for storing and chilling drinking water in the refrigeration appliance 100 with water being dispensed automatically. The water tank has an inlet 107 and an outlet 109. The inlet 107 and outlet 109 are adjacent to one another in an upper region of the water tank 103 and are connected to hose lines 113 and 117. The drinking water is supplied to the water tank 103 through the inlet hose 113. The drinking water is conducted out of the water tank 103 through the outlet hose 117. The inlet hose 113 connects the inlet 107 of the water tank 103 to a water supply and the outlet hose 117 connects the outlet 109 of the water tank 103 to a dispenser unit.

Figure 3:
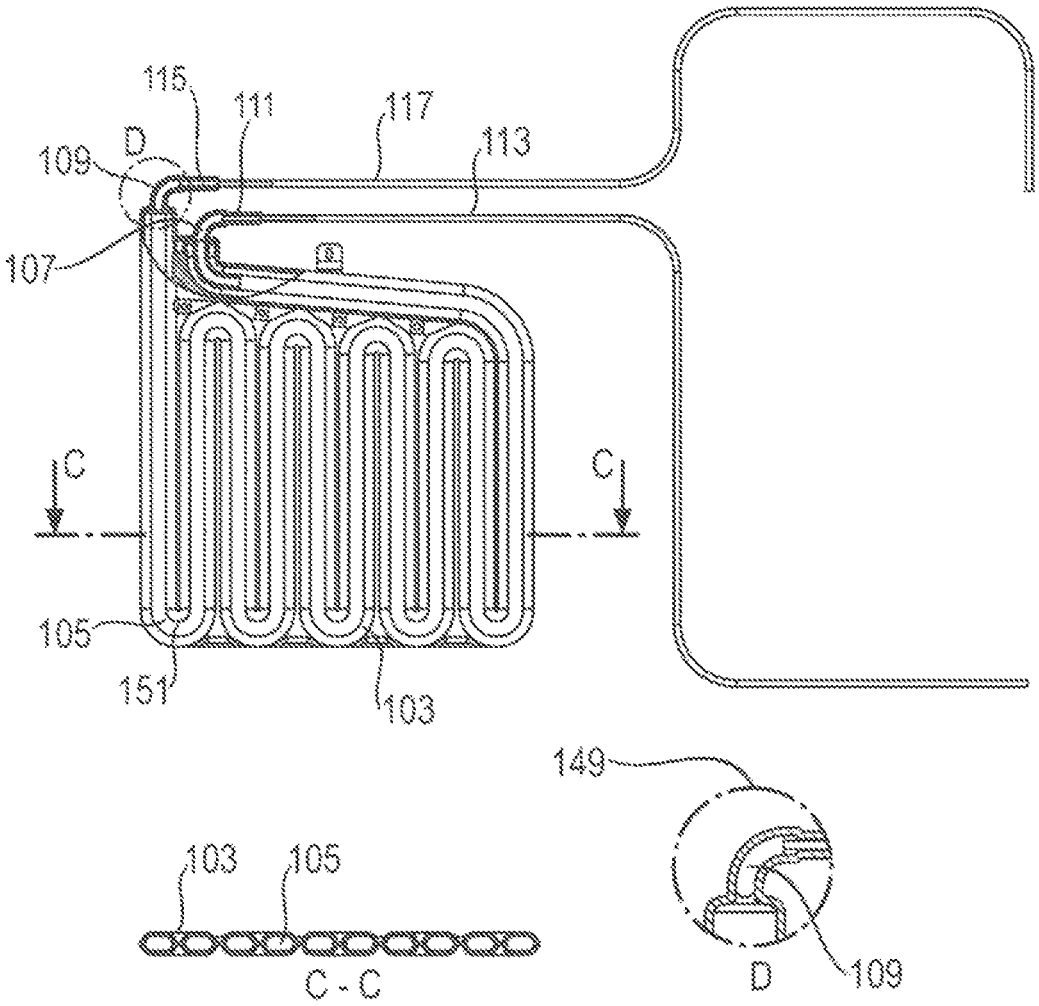
FIG. 3 shows a view of the water tank with different cross-sectional views.

FIG. 3 shows a view of the water tank 103 with different cross-sectional views. The water tank 103 comprises a water channel 105 that runs in a serpentine manner between the inlet 107 and the outlet 109 and has the largest possible radii 151 in its serpentine course. The cross section of the water channel has a round or elliptical shape. The water channel 105 has essentially the same dimensions along its course. This improves the flow through the water tank 103 and minimizes potential bacteria collection points.

The shape and dimensions of the cross section change in the region of the transitions 149 between the water channel 105 and the inlet 107 or outlet 109. The hose lines 113 and 117 are connected to the inlet 107 and outlet 109 of the water tank 103 in a non-detachable and water-tight manner. This connection is primarily achieved by means of a material-fit connection such as welding or thermal pressing. Such a connection protects the connecting points of the hose lines 113 and 117 to the water tank 103 against leaks in particular.

Figure 4:
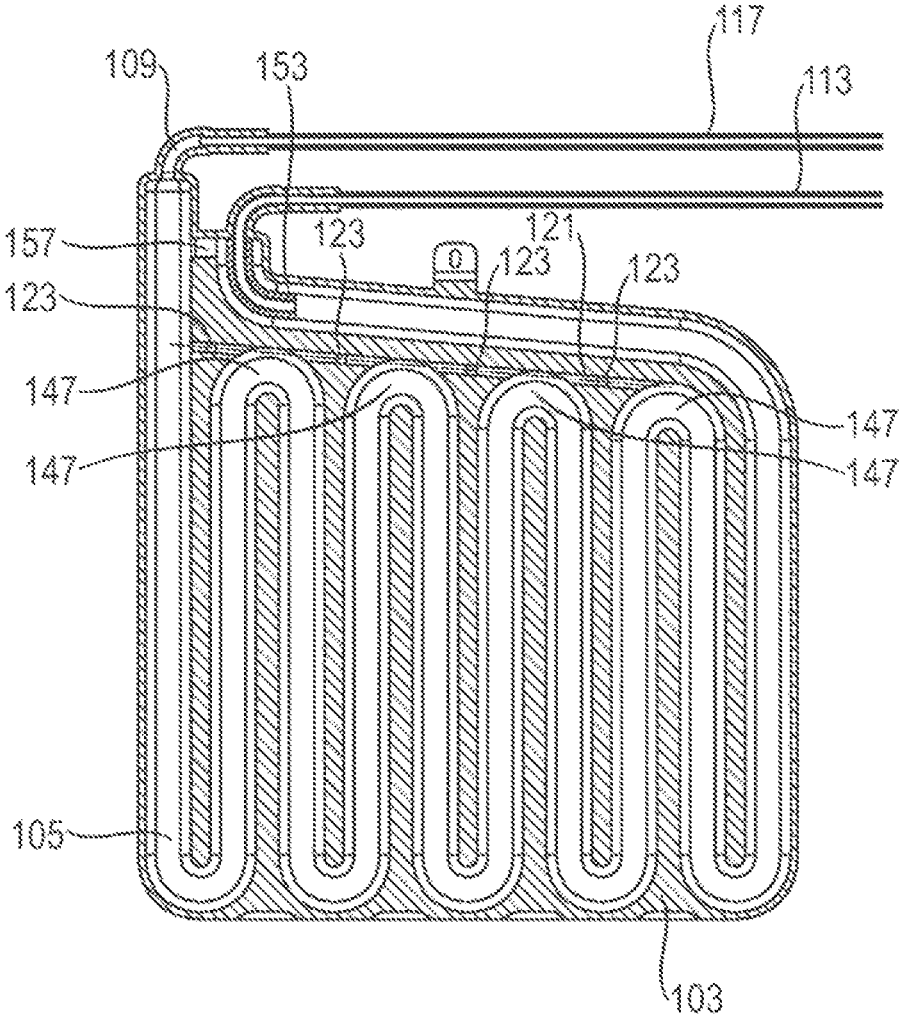
FIG. 4 shows an enlarged view of the water tank.

FIG. 4 shows an enlarged view of the water tank 103. The water tank 103 is equipped with one or more venting channels 121 in the upper or another physically favorable region, so that the channel regions that would trap air when the water tank 103 is filled are vented by the venting channel 121.

The residual air is conducted through the venting channel 121 to the outlet 109, where it is conducted out of the water tank 103 by way of the outlet line. The venting channel 121 is dimensioned and positioned in such a manner that drinking water flowing into the water tank 103 is not conducted to the outlet 109 through the venting channel 121. To this end the venting channel 121 comprises additional constrictions 123, which stem or prevent the passage of drinking water.

An inlet venting channel 157 is formed between the inlet 107 and the outlet 109. In order to stem the unwanted flow of the unchilled drinking water through the inlet venting channel 157, a defined length of the inlet hose 113 is pushed into the interior of the water tank 103. The hose segment 153 of the pushed in inlet hose 113 is at a favorable distance from the inlet venting channel 157 and conducts the introduced drinking water past the inlet venting channel 157 so the passage of drinking water is prevented.

A favorably configured and positioned venting channel 121, the constrictions 123, the inlet venting channel 157 and the inlet hose 113 pushed into the water tank 103 essentially contribute to a more effective dispensing of chilled drinking water and prevent the mixing of warm and cold drinking water.

Figure 5:
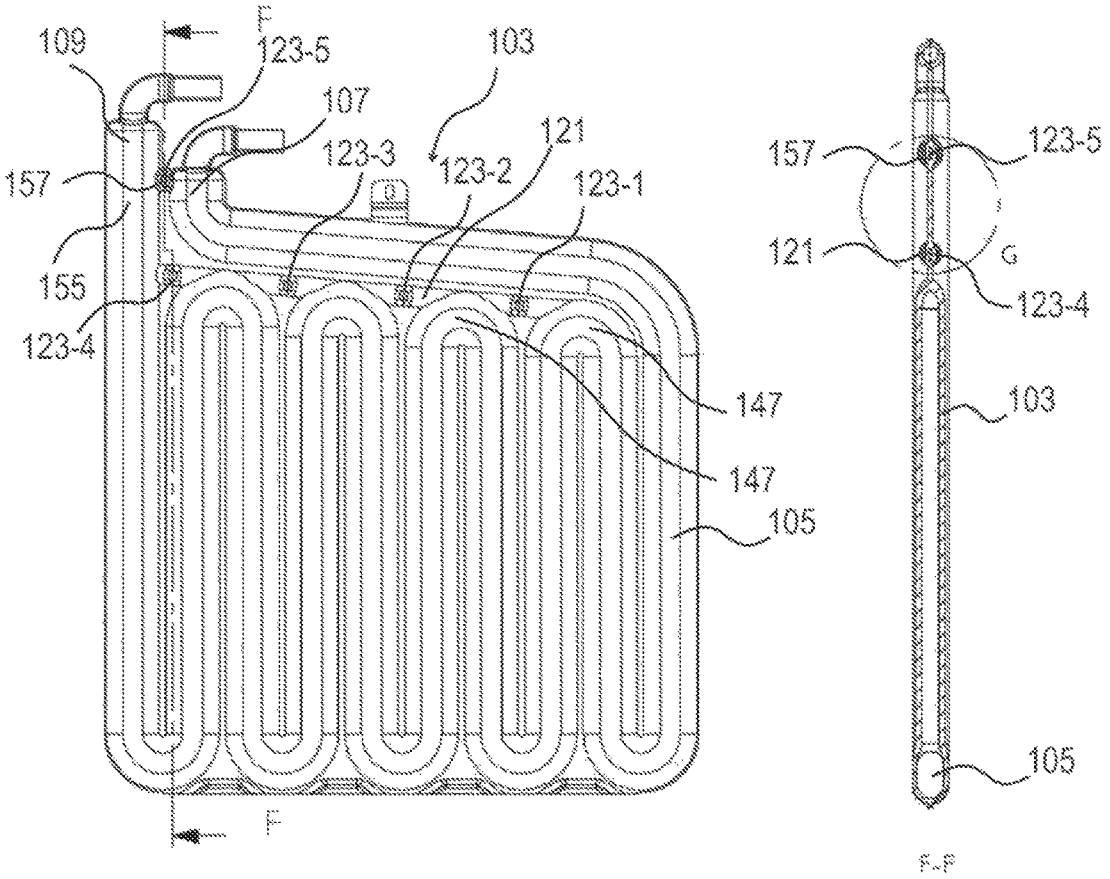
FIG. 5 shows a plan view of the water tank and an enlarged cross-sectional view through constrictions of the venting channel.
Figure 5:
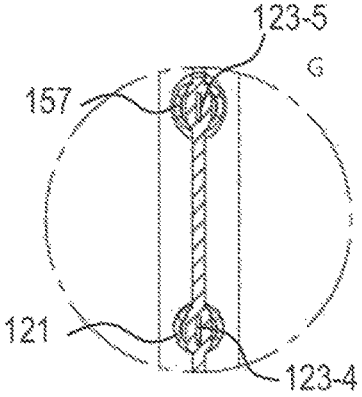

FIG. 5 shows the water tank 103 in a plan view and in a cross-sectional view as well as an enlarged cross-sectional view through the constrictions 123-4 and 123-5. The water tank 103 comprises the serpentine water channel 105 for storing the drinking water. The venting channel 121 serves to vent the serpentine water channel 105. To this end the venting channel 121 connects the upper bends 147 of the serpentine course so that air that has collected in said bends 147 can be conducted out.

In order to stem or prevent the passage of drinking water through the venting channel 121, constrictions 123-1, 123-2, 123-3 and 124-4 are formed therein, through which the air can flow and which form a significant flow resistance for water because of the higher viscosity. The constrictions 123-1, 123-2 and 123-3 are each located between two bends 147 of the serpentine course. The restriction 123-4 of the venting channel 121 is arranged in an outlet region 155 of the water channel 105.

The venting channel 121 is connected to the outlet region 155 of the water channel 105, so that air can be conducted out as drinking water is dispensed. The venting channel 121 connects the bends 147 in a straight line and is at an angle to the horizontal so that air in the venting channel 121 is conducted upward. This prevents the collection of air in the venting channel 121.

The constrictions 123-1, 123-2, 123-3, 123-4 are formed with a cross section in the manner of a slit. The slit-like constrictions 123-1, 123-2, 123-3, 123-4 can be produced in a particularly simple manner during the manufacture of the water tank 103, for example by squashing together both sides of the venting channel 121 of the water tank 103, which has been produced using blow-molding procedures, in a further processing step using a special tool. This processing step forms constrictions 123-1, 123-2, 123-3, 123-4, which run in the manner of slits from an upper face of the venting channel 121 to a lower face of the venting channel 121.

In a further embodiment the constrictions 123 can have a different shape however and can be arranged at a different point within the venting channel 121. For example it is advantageous to form the constrictions 123-1, 123-2, 123-3, 123-4 in the region of an upper wall of the venting channel 121, so that air that is predominantly at the top passes through the constrictions 123-1, 123-2, 123-3, 123-4.

An inlet venting channel 157 for venting the inlet 107 runs between the adjacently arranged inlet 107 of the water channel 105 and the outlet 109 of the water channel 105. A further constriction 123-5 for stemming the passage of drinking water through the inlet venting channel 157 is formed in the inlet venting channel 157.

Figure 6:
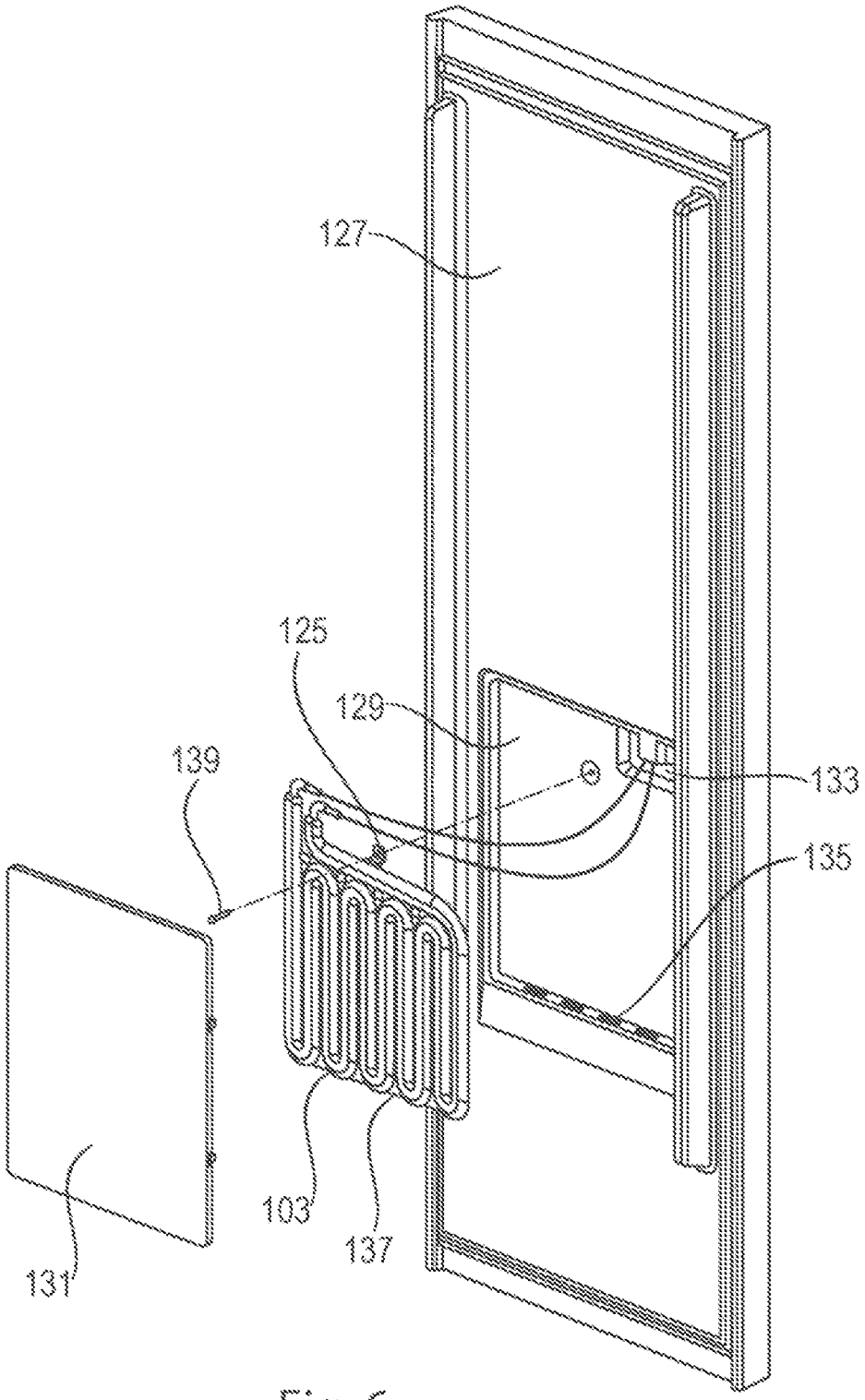
FIG. 6 shows a view of a refrigerator door in association with the water tank.

FIG. 6 shows a view of a door 127 of the refrigeration appliance 100 in association with the water tank 103. The water tank 103 is positioned in the door 127 of the refrigeration appliance 100. To this end the door 127 of the refrigeration appliance 100 has a corresponding wall recess 129, on the lower face of which retaining projections 135 for securing a lower edge 137 of the water tank 103 are formed. The water tank 103 is inserted into the wall recess 129 so that the lower edge 137 of the water tank 103 is located behind the retaining projections 135.

The water tank 103 is then fastened in an upper region of the wall recess 129 by way of a centrally arranged fastening opening 125 for fastening the water tank 103. This is done by means of a fastening screw 139 inserted into the fastening opening 125 and with which the water tank 103 is screwed to the door 127 in the upper region.

The hose lines 113 and 117 of the water tank 103 are passed to passages in an inner door 133 and conducted to the dispenser unit and the water supply through empty conduits foamed into the door 127 of the refrigeration appliance 100. The water tank 103 and hose lines 113 and 117 can still be disassembled as required as a result of the foamed-in empty conduits.

After the water tank 103 has been inserted and screwed into place, a cover 131 is put in place, which covers the water tank 103 inserted into the wall recess 129 and forms a flat surface with the remainder of the wall of the door 127. To this end the cover 131 or wall recess 129 can comprise corresponding latching means, so the cover 131 can be fitted onto the wall recess 129.

Figure 7:
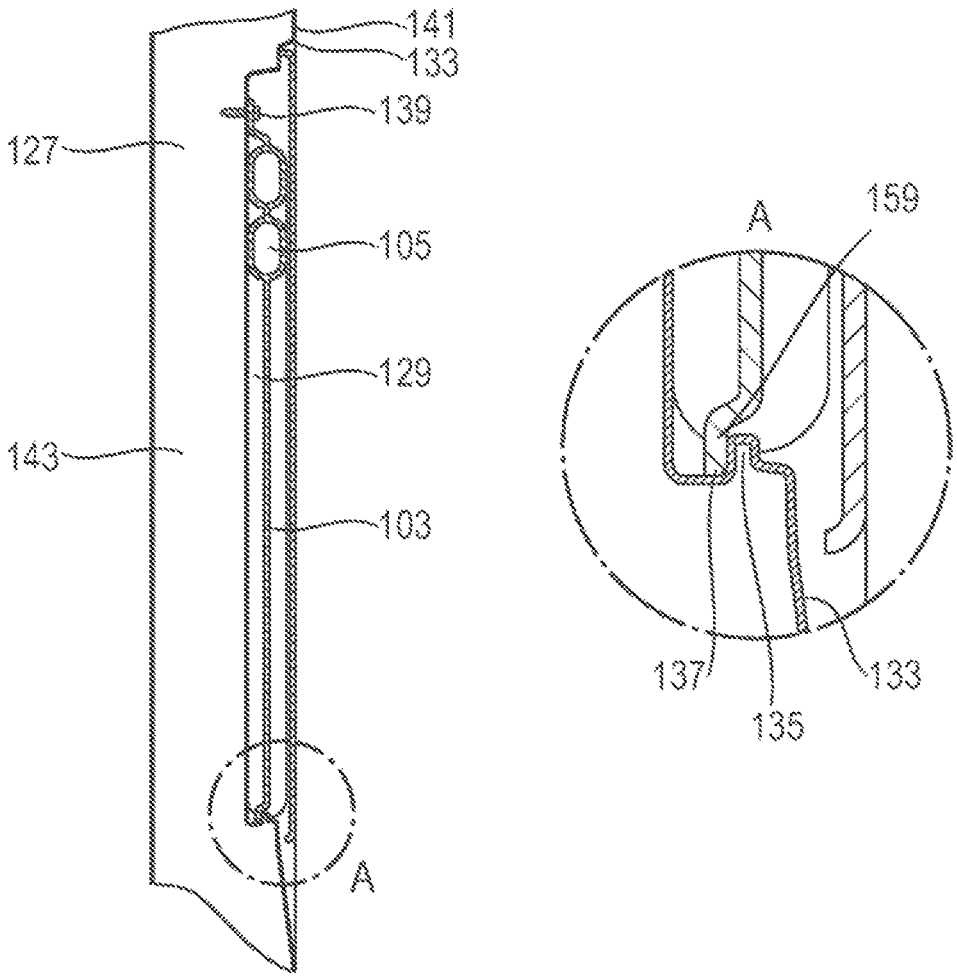
FIG. 7 shows a cross-sectional view through the refrigerator door.

FIG. 7 shows a cross-sectional view through the door 127 of the refrigeration appliance 100. The water tank 103 is fastened in such a manner that the lower edge 137 in the lower region of the water tank 103 is introduced or pushed in behind a retaining projection 135 in the inner door 133 and then secured with a fastening screw 139 in the upper, central region.

The lower edge 137 of the water tank 103 is formed by a tank segment 159 which projects on a lower face of the water tank 103. This tank segment 159 is displaced in the direction of the wall recess 129 so that the lower edge 137 of the water tank 103 can be inserted easily behind the retaining projection 135.

The retaining projection 135 is formed for example by an indentation in an inner wall of the refrigeration appliance 100. The retaining projection 135 can be formed in the wall recess 129 in such a manner that it extends over the entire width of the lower edge 137 of the water tank 103.

The wall recess 129 accommodates the water tank 103 in such a manner that it does not protrude beyond the surface 141 of the inner door 133. The residual insulation thickness 143 of the door 127 of the refrigeration appliance 100 is dimensioned such that the insulating function of the door 127 is not influenced in a negative manner.

In order to compensate for any play of the water tank 103, an elastic damping element (not shown) can also be arranged between the retaining projection 135 and the water tank 103, being compressed into the wall recess 129 when the water tank 103 is inserted and absorbing vibration. For example the damping element can be bonded to the lower edge 137 of the water tank 103 so that it is incorporated at the same time as the water tank 103 is inserted.

Figure 8:
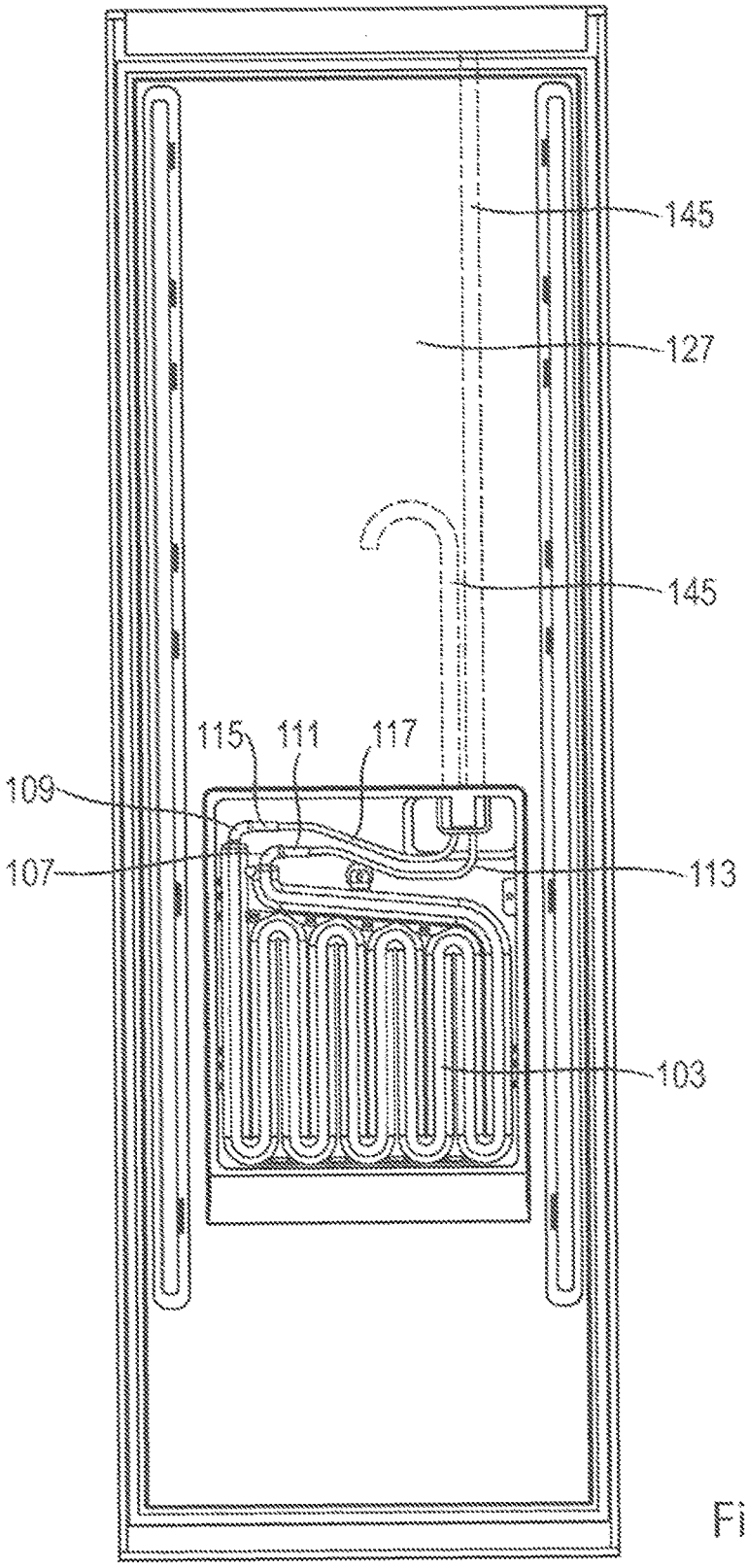
FIG. 8 shows a plan view of the refrigerator door.

FIG. 8 shows a plan view of the door 127 of the refrigeration appliance 100. The connection nozzles 111 and 115 of the hose lines 113 and 117 are arranged at a favorable distance from the passages in the inner door 133. This arrangement offers favorable preconditions for simple fitting of the water tank 103 and the hose lines 113 and 117.

The water tank 103 can thus be secured in the inner door 133 and the hose lines 113 and 117 can be pushed without kinking into the passages in the inner door 133 and into the foamed-in empty conduits 145. It also creates space for accommodating any excess length of the hose lines 113 and 117. This excess length can be used to compensate for tolerances when positioning the hose lines 113 and 117 and when fitting connecting components to the hose lines 113 and 117.

In a further embodiment the water tank 103 can be configured in such a manner that the water tank 103 does not require a cover 131 for function and appearance. The face of the water tank 103 facing a cooling chamber can be configured correspondingly for this purpose. In this instance the water tank 103 can have a flat outer face.

In a further embodiment the water tank 103 can be fastened in such a manner that this is brought about totally or partially by way of the cover 131, for example in that the cover 131 has latching means which engage in the inner door 133.

The water tank 103 is embodied to be as flat as possible for example, so that it can be incorporated in a door 127 of the refrigeration appliance 100. The water tank 103 can also be fitted easily in a door 127 of the refrigeration appliance 100 and can be replaced easily in the event of a service call. Permanently connected hose lines mean that there is little risk of leaks. Because the course of the water channel 105 has no indentations or corners there are few contamination points.

If the hose lines 113 and 117 have a certain excess length, the components can easily be connected. The excess length of the hose lines 113 and 117 can be arranged in proximity to the water tank 103. The water tank 103 is able to chill a defined quantity of water to below a defined temperature and to store it so that it can then be dispensed within a defined temperature range.

The water tank 103 can be arranged in the door without taking up space in the interior chamber. The water tank 103 also has a large surface for an effective exchange of heat and the chilling of drinking water. Because the hose lines 113 and 117 are welded in place there is little risk of leaks at the inlet 107 and outlet 109 of the water tank 103. Regular channel cross sections with a serpentine course with large radii ensure a more efficient throughflow and avoid potential bacteria collection points. Simple fastening of the water tank 103 is achieved by retaining projections 135 for securing a lower edge of the water tank 103, the particularly configured floor region of the water tank 103 and an individual fastening screw 139. The retaining projections 135 are formed for example by indentations in the inner door 133.

Replacement of the water tank 103 and the hose lines 113 and 117 is permitted by the use of foamed-in empty conduits in the door 127 of the refrigeration appliance 100.

All the features explained and illustrated in association with individual embodiments of the invention can be provided in different combinations in the inventive subject matter, in order to achieve their advantageous effects simultaneously.

The scope of protection of the present invention is defined by the claims and is not restricted by the features explained in the description or shown in the figures.

LIST OF REFERENCE CHARACTERS

100 Refrigeration appliance
103 Water tank
105 Water channel
107 Inlet
109 Outlet
111 Inlet connection nozzle
113 Inlet hose
115 Outlet connection nozzle
117 Outlet hose
121 Venting channel
123-1-123-5 Constriction
125 Fastening opening
127 Door
129 Wall recess
131 Cover
133 Inner door
135 Retaining projection
137 Lower edge
139 Fastening screw
141 Surface
143 Residual insulation thickness
145 Empty conduit
147 Bend
149 Transitions
151 Radii of serpentine course
153 Hose segment
155 Outlet region
157 Inlet venting channel
159 Tank segment

The invention claimed is:

1. A refrigeration appliance, comprising:

a water tank for drinking water, said water tank having a water channel for storing the drinking water, a venting channel for venting said water channel, and a constriction formed in said venting channel for stemming a passage of the drinking water through said venting channel;

said water channel running in a serpentine manner within said water tank defining a serpentine course;

said water channel having upper bends;

said venting channel connecting two of said upper bends of said serpentine course; and said constriction of said venting channel formed between two of said upper bends of said serpentine course.

2. The refrigeration appliance according to claim 1, wherein said venting channel connects all of said upper bends of said serpentine course.

3. The refrigeration appliance according to claim 1, wherein:

said water channel has an outlet region; and said venting channel is connected to said outlet region of said water channel.

4. The refrigeration appliance according to claim 1, wherein said venting channel runs in a straight line.

5. The refrigeration appliance according to claim 1, wherein said constriction is formed in a manner of a slit.

6. The refrigeration appliance according to claim 1, wherein said venting channel has an upper wall and said constriction is formed in a region of said upper wall of said venting channel.

7. The refrigeration appliance according to claim 1, wherein said water channel has an outlet and an inlet formed adjacent to said outlet.

8. The refrigeration appliance according to claim 7, wherein said water tank has an inlet venting channel, said inlet of said water channel is connected to said outlet of said water channel by said inlet venting channel for venting said inlet.

9. The refrigeration appliance according to claim 8, wherein said inlet has a hose segment in an interior of said water channel for conducting the drinking water past said inlet venting channel.

10. A refrigeration appliance, comprising:

a water tank for drinking water, said water tank having a water channel for storing the drinking water, a venting channel for venting said water channel, and a constriction formed in said venting channel for stemming a passage of the drinking water through said venting channel;

said water channel having an outlet and an inlet formed adjacent to said outlet of said water channel; and said water tank further having an inlet venting channel, said inlet of said water channel is connected to said outlet of said water channel by said inlet venting channel for venting said inlet of said water channel.

11. The refrigeration appliance according to claim 1, wherein said water tank is a blow-molded tank.

12. A refrigeration appliance, comprising:

a water tank for drinking water, said water tank having a water channel for storing the drinking water, a venting channel for venting said water channel, and a constriction formed in said venting channel for stemming a passage of the drinking water through said venting channel;

said water channel having an outlet region;

said venting channel being connected to said outlet region of said water channel; and said constriction of said venting channel disposed in said outlet region of said water channel.

13. A refrigeration appliance, comprising:

a water tank for drinking water, said water tank having a water channel for storing the drinking water, a venting channel for venting said water channel, and a constriction formed in said venting channel for stemming a passage of the drinking water through said venting channel, said constriction being formed in a manner of a slit.

14. The refrigeration appliance according to claim 10, wherein said constriction for stemming the passage of the drinking water through said inlet venting channel is formed in said inlet venting channel.

* * * * *